US008157764B2

(12) United States Patent
Makowski et al.

(10) Patent No.: US 8,157,764 B2
(45) Date of Patent: Apr. 17, 2012

(54) PATIENT HYDRATION SYSTEM

(75) Inventors: Candice Ann Makowski, Wheatridge, CO (US); Mary Virginia Makowski, Capitan, NM (US); Cicelee Renee Makowski, Wheatridge, CO (US)

(73) Assignee: MakInnovations, LLC, Ruidoso Downs, NM (US)

( * ) Notice: Subject to any disclaimer, the term of this patent is extended or adjusted under 35 U.S.C. 154(b) by 0 days.

(21) Appl. No.: 12/802,809

(22) Filed: Jun. 15, 2010

(65) Prior Publication Data

US 2010/0318024 A1 Dec. 16, 2010

Related U.S. Application Data

(60) Provisional application No. 61/268,790, filed on Jun. 15, 2009.

(51) Int. Cl.
*A61J 7/00* (2006.01)

(52) U.S. Cl. ..... 604/77

(58) Field of Classification Search ..... 604/77, 604/79; 220/703, 705, 709
See application file for complete search history.

(56) References Cited

U.S. PATENT DOCUMENTS

| | | | | |
|---|---|---|---|---|
| 2,756,740 | A * | 7/1956 | Deane | 604/77 |
| 4,196,747 | A * | 4/1980 | Quigley et al. | 137/527.8 |
| 4,966,580 | A * | 10/1990 | Turner et al. | 604/67 |
| 5,484,405 | A * | 1/1996 | Edstrom, Sr. | 604/77 |
| 7,207,968 | B1 * | 4/2007 | Harcinske | 604/77 |
| 7,214,239 | B2 * | 5/2007 | Chen | 606/236 |
| 2002/0092858 | A1 * | 7/2002 | Bowman | 220/709 |
| 2002/0115961 | A1 * | 8/2002 | Writt, Sr. | 604/28 |
| 2005/0035160 | A1 * | 2/2005 | Forsman | 224/148.2 |
| 2005/0261739 | A1 * | 11/2005 | Chen | 606/234 |
| 2007/0034634 | A1 * | 2/2007 | Brown | 220/703 |

* cited by examiner

*Primary Examiner* — Nicholas Lucchesi
*Assistant Examiner* — Aarti B Berdichevsky

(57) ABSTRACT

A patient hydration system comprises a bladder, a flexible tube, a safety guard, and a mouthpiece. The bladder can be a generally rectangular-shaped pouch designed to hold liquids. The bladder can have an attachment means whereby a retention member can be used to hang the bladder. The bladder has a port that allows the attachment of the flexible tube. The tube is also connected to the safety guard and mouthpiece. The contents of the bladder flow through the tube and out of the mouthpiece on demand. A keeper clip can be added in proximity to the mouthpiece. The safety guard provides a substantial handle for grasping and maneuvering the system, ensures that the mouthpiece is not inadvertently swallowed by the patient, and protects the mouthpiece from surface contamination if the mouthpiece is placed on a table, plate, etc.

16 Claims, 3 Drawing Sheets

PATIENT HYDRATION SYSTEM

CROSS-REFERENCE TO RELATED APPLICATIONS

This application claims the benefit of U.S. Provisional Application No. 61/268,790 entitled PATIENT HYDRATION SYSTEM, filed Jun. 15, 2009, which is specifically incorporated herein by reference for all that it discloses and teaches.

TECHNICAL FIELD

This invention relates generally to the medical field and, in particular, to a patient hydration system.

BACKGROUND

When people are ill or otherwise receiving medical care, it is especially important that they maintain adequate hydration. Unfortunately, all too often an illness or medical condition can cause a patient to experience reduced motor function and an inability to sit upright and drink from a cup or other container without assistance. This exacerbates the demands on an already burdened caregiver, necessitating constantly assisting the patient with liquid intake in order for the patient to stay properly hydrated. Furthermore, it can be difficult for caregivers or medical personnel to properly monitor the amount of liquid intake since spillage is riot infrequent and accurately measuring the amount of liquid consumed using the standard pitcher/cup method is problematic at best. A commonly employed alternative is intravenous administration of liquids, which unfortunately has its own complications and associated problems. Another possible alternative is the use of backpack-style canteens that employ hoses and bite-valves. However, such devices are not safe to use in a medical environment, nor do they provide the features necessary to address the needs of a patient; thus, they are not employed in the medical setting. Therefore, there is a need for an improved patient hydration system that safely addresses the above limitations and problems.

SUMMARY

Embodiments of the present invention described and claimed herein address the foregoing limitations and problems by providing a patient hydration system. The present invention comprises a liquid holding vessel or bladder, a flexible tube, a safety guard, and a mouthpiece. Additional components can include a retention member, a secondary port, a keeper clip, and/or a shutoff valve.

In one embodiment, the bladder is a generally rectangular-shaped pouch designed to hold a plurality of liquids. Preferably, the bladder can contain approximately sixty-four fluid ounces—although lesser and greater amounts are contemplated. In an upper corner, the bladder can have an attachment means whereby a retention member can be used to hang the bladder from an "IV-tree", wheelchair, bed frame, etc. In an opposite, lower corner, the bladder can have a port that allows attachment of the flexible tube. The tube can be attached permanently or it can be removable. The bladder can be pre-filled with water, other liquids, etc., or the port can be manufactured so that it can be opened and thereby allow a caregiver to add water, liquids, etc. to the bladder.

The opposite end of the flexible tube is attached to the safety guard and mouthpiece. The contents of the bladder flow through the tube and out of the mouthpiece on demand.

This is accomplished by one of a number of activating methods that act upon a valve: the patient can apply suction with his or her mouth to the mouthpiece causing a pressure valve to open, the patient can bite the mouthpiece and cause a bite valve to open, the patient or caregiver can manually actuate a valve with his or her fingers, etc. Thus, the patient hydration system can be customized to deliver liquids based on the abilities and needs of an individual patient.

A keeper clip can be added in proximity to the mouthpiece. This clip is attached to the flexible tube, mouthpiece, and/or safety guard such that it allows the system to be removably attached to the patient's clothes or to some other handy location that maintains easy-access to the system. A shutoff valve can be located between the bladder and the mouthpiece to allow the delivery of liquids to be turned off.

The safety guard provides a substantial handle for grasping and maneuvering the system, ensures that the mouthpiece is not inadvertently swallowed by the patient, and protects the mouthpiece from surface contamination if the mouthpiece is placed on a table, plate, etc.

In one embodiment, the mouthpiece comprises a bite-valve that opens and allows liquids to flow when the patient bites down on the valve. The valve closes and the flow of liquids ceases when the patient releases the pressure on the valve. In another embodiment, the valve opens when the patient applies suction to the valve with his or her mouth. In yet another embodiment, the valve can be manually actuated using the fingers.

The present invention provides many benefits over the prior art. A patient hydration system allows patients in a weakened state or those with limited mobility, skill or agility to intake liquids without assistance from a caregiver. Thus, it reduces a caretaker's responsibilities while allowing for more accurate measurements of patient fluid intake. The system provides easy access to liquids (including during transportation of a patient) and avoids potential spillage. It reduces bedside clutter and allows the patient to have control over the intake of liquids. All of this is accomplished without creating a choking hazard for the patient or inadvertently increasing the possibility of exposure to potential contamination.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein.

DETAILED DESCRIPTION

In one embodiment, a patient hydration system comprises a bladder, a flexible tube, a safety guard, and a mouthpiece. Additional components can include a retention member, a secondary port, a keeper clip, and/or a shutoff valve. The bladder is a generally rectangular-shaped pouch designed to hold a plurality of liquids. The bladder can have an attachment means whereby a retention member can be used to hang the bladder. The bladder also has a port that allows the attachment of one end of the flexible tube to the bladder. The other end of the flexible tube is attached to the safety guard and mouthpiece. The contents of the bladder flow out the port, through the tube and out of the mouthpiece on demand. A keeper clip can be added in proximity to the mouthpiece. This clip is attached to the flexible tube, mouthpiece, and/or safety guard such that it allows the system to be removably attached to the patient's clothes or to some other convenient location. A shutoff valve can also be incorporated. The safety guard provides a substantial handle for grasping and maneuvering the system, ensures that the mouthpiece is not inadvertently swallowed by the patient, and protects the mouthpiece from surface contamination if the mouthpiece is placed on a table, plate, etc. The mouthpiece can comprise a bite valve, a suction valve, a pressure valve, etc.

Figure 1:
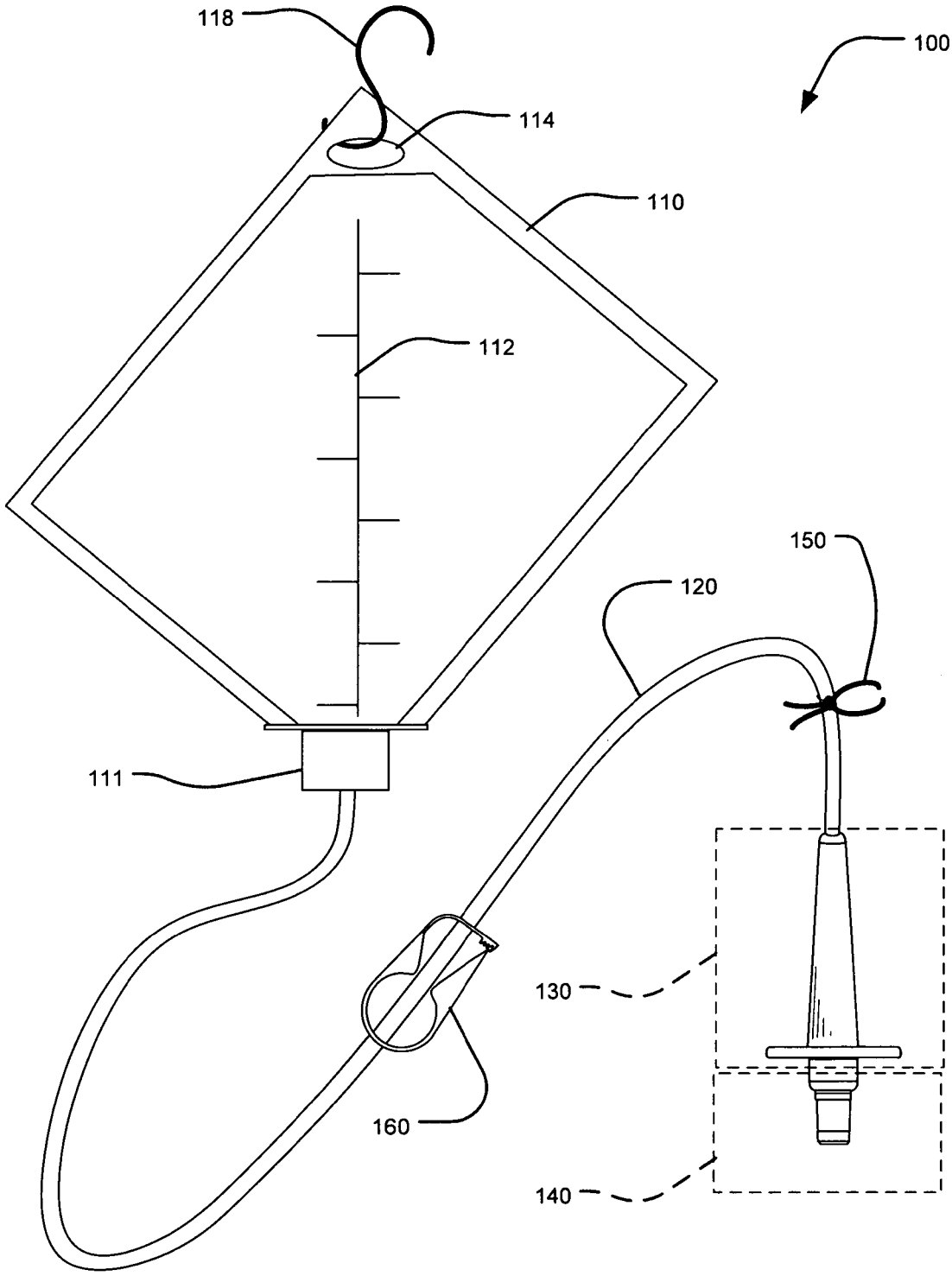
FIG. 1 illustrates a front view of an exemplary embodiment of a patient hydration system.

FIG. 1 illustrates a front view of an exemplary embodiment of a patient hydration system 100. The components shown in FIG. 1 include a liquid holding vessel or bladder 110, a flexible tube 120, a safety guard 130, and a mouthpiece 140. Additional components can include a retention member 118, a secondary port (not shown), a keeper clip 150, and/or a shutoff valve 160. In one embodiment, the bladder 110 is a generally rectangular-shaped pouch designed to hold a plurality of liquids. Preferably, the bladder 110 can contain approximately sixty-four fluid ounces—although lesser and greater amounts are contemplated. The bladder 110 can have measuring indicia 112 printed or otherwise depicted on the bladder 110. If the bladder 110 is constructed out of translucent or transparent materials, the level of liquid in the bladder 110 can be seen and compared to the measuring indicia 112 to determine how much fluid remains in the bladder 110 and/or how much fluid has been consumed. Alternatively, the measuring indicia 112 can be omitted from the system 100. In other embodiments, other indicia such as patient name, bladder contents, expiration date, administration date, etc. can be added to the system 100.

The system 100 can be constructed utilizing PVC and DEHP free materials. Construction materials can include: polyethelene, bio-plastics, plastics, rubber, silicone, etc. The system 100 is designed for usage with water, electrolytes, juices, other non-carbonated beverages, liquid vitamins, and any type of additive that could be mixed with liquids and administered to a patient orally. The system 100 can be disposable or it can be cleaned and reused (in one embodiment, the tube 120 can be removed or unscrewed from the bladder 110 and safety guard 130 and mouthpiece 140 and then the components can be cleaned with a low-suds solution). Alternatively, various components or the entire system 100 can be disposable and replaced as desired.

In an upper corner, the bladder 110 can have an attachment means 114 whereby a retention member 118 can be used to hang the bladder 110 from an "IV-tree", wheelchair, bed frame, etc. Preferably, the attachment means 114 comprises a reinforced section of the bladder 110 having a hole therein for receiving the retention member 118. The retention member 118 provides a hook to engage the IV-tree, wheelchair, bedframe, etc. and a loop for engaging the attachment means 114. Other attachment means 114 are contemplated, such as clips, hangers, S-hooks, etc.

In a lower corner, the bladder 110 can have a port 111 that allows the attachment of the flexible tube 120. The port 111 can comprise a simple round opening giving access to the interior of the bladder 110. Other shapes are contemplated. Alternatively, the port 111 can further comprise a threaded male fitting to allow the secure and leak-proof attachment of the tube 120. In another embodiment, the port 111 has a built-in shut-off valve to allow the patient, caregiver, etc. to turn off the flow of liquids from the bladder 110 into the tube 120. In yet another embodiment, the shut-off valve is a separate component 160 that comprises a pressure clamp that constricts the tube and can be locked in place allowing the flow of liquids to be customizably limited and/or completely shut off.

The proximal end of the tube 120 can be attached permanently to the port 111 or it can be removable. In one embodiment, the tube 120 slides over a round, barbed protrusion extending downwards from the port 111. As the tube is forced over the protrusion and barb, the deformation of the flexible tube 120 forces retention thereof on the protrusion of the port 111—the barb further ensures that the tube 120 remains attached to the port 111. In another embodiment, the proximal end of the tube 120 has a threaded female fitting which screws onto a threaded male fitting on the port 111 (the relative positions of the male/female fittings can be reversed). In other embodiments, other means for attaching the tube 120 to the port 111 are contemplated. Additionally, the connection between the tube 120 and the bladder 110 can incorporate a swivel so that the tube 120 is free to rotate without twisting the bladder 110. Preferably, the tube 120 is approximately three feet in length, although other lengths are contemplated.

The bladder 110 can be pre-filled with water, other liquids, etc., or the port 111 can be manufactured so that it can be opened and thereby allow a caregiver to add water, liquids, etc. to the bladder 110. In another embodiment, a secondary port (not shown) can be added to the bladder 110. Such a secondary port can provide a larger opening for ease of adding ice, liquids, etc. to the bladder 110. A zipper or other means of opening and closing the secondary port while retaining the overall water-tight integrity of the bladder 110 can be utilized.

The distal end of the flexible tube 120 is attached to the safety guard 130 and mouthpiece 140. The contents of the bladder 110 flow through the tube 120 and out of the mouthpiece 140 on demand. This is accomplished by one of a number of activating methods, the methods being potentially dependent on the type of mouthpiece 140 employed in a given embodiment: the patient can apply suction with his or her mouth to the mouthpiece 140, the patient can bite the mouthpiece 140 and cause a bite-valve to open, the patient or caregiver can manually actuate a valve with his or her fingers, etc. Thus, the patient hydration system 100 can be customized to deliver liquids based on the abilities and needs of an individual patient.

A keeper clip 150 can be added in proximity to the safety guard 130. This clip 150 is attached to the flexible tube 120, mouthpiece 140, and/or safety guard 130 such that it allows the system 100 to be removably attached to the patient's clothes or to some other handy location that maintains easy-access to the system 100. The clip 150 can be a simple spring-loaded, alligator-type clip that securely holds the system 100 in place. Other types of clips are contemplated.

A shutoff valve 160 can be located between the bladder 110 and the mouthpiece 140 to allow the delivery of liquids to be turned off. The shutoff valve 160 can be a simple ball valve, a diaphragm valve, etc. In another embodiment, a clamp-valve can be used (as shown in FIG. 1). The clamp-style valve uses the pressure of two contact points to squeeze the flexible tube 120 shut. As shown in FIG. 1, a clamp valve allows for easy one-handed operation and permits flow to be partially restricted of completely shut off. The clamp valve can be locked in position to allow full-flow, no-flow, or a constantly-restricted customizable flow of liquids.

The safety guard 130 provides a substantial handle for grasping and maneuvering the system 100, ensures that the mouthpiece 140 is not inadvertently swallowed by the patient, and protects the mouthpiece 140 from surface contamination if the mouthpiece 140 is placed on a table, plate, etc. Furthermore, the slots in the safety guard 130 can be used in conjunction with an S-hook or other type of hook to hang the safety guard 130 from an IV-tree or other location.

In one embodiment, the mouthpiece 140 comprises a bite-valve that opens and allows liquids to flow when the patient bites down on the valve. The valve closes and the flow of liquids ceases when the patient releases the pressure on the valve. In another embodiment, the valve opens when the patient applies suction to the valve with his or her mouth. In yet another embodiment, the valve can be manually actuated using the fingers.

Figure 2:
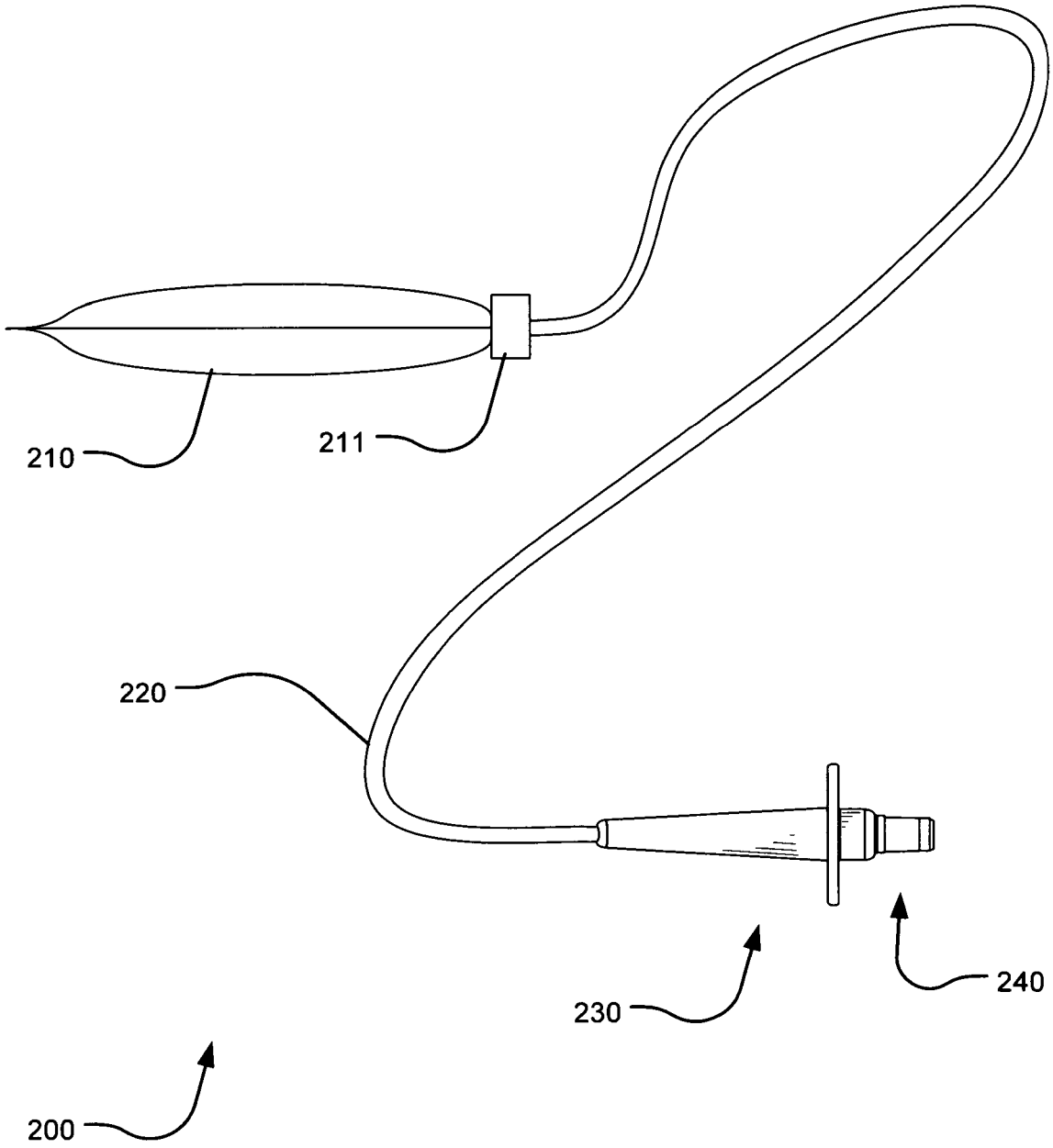
FIG. 2 illustrates a side view of an exemplary embodiment of a patient hydration system.

FIG. 2 illustrates a side view of an exemplary embodiment of a patient hydration system 200. The components shown in FIG. 2 include a bladder 210, a flexible tube 220, a safety guard 230, and a mouthpiece 240.

Figure 3:
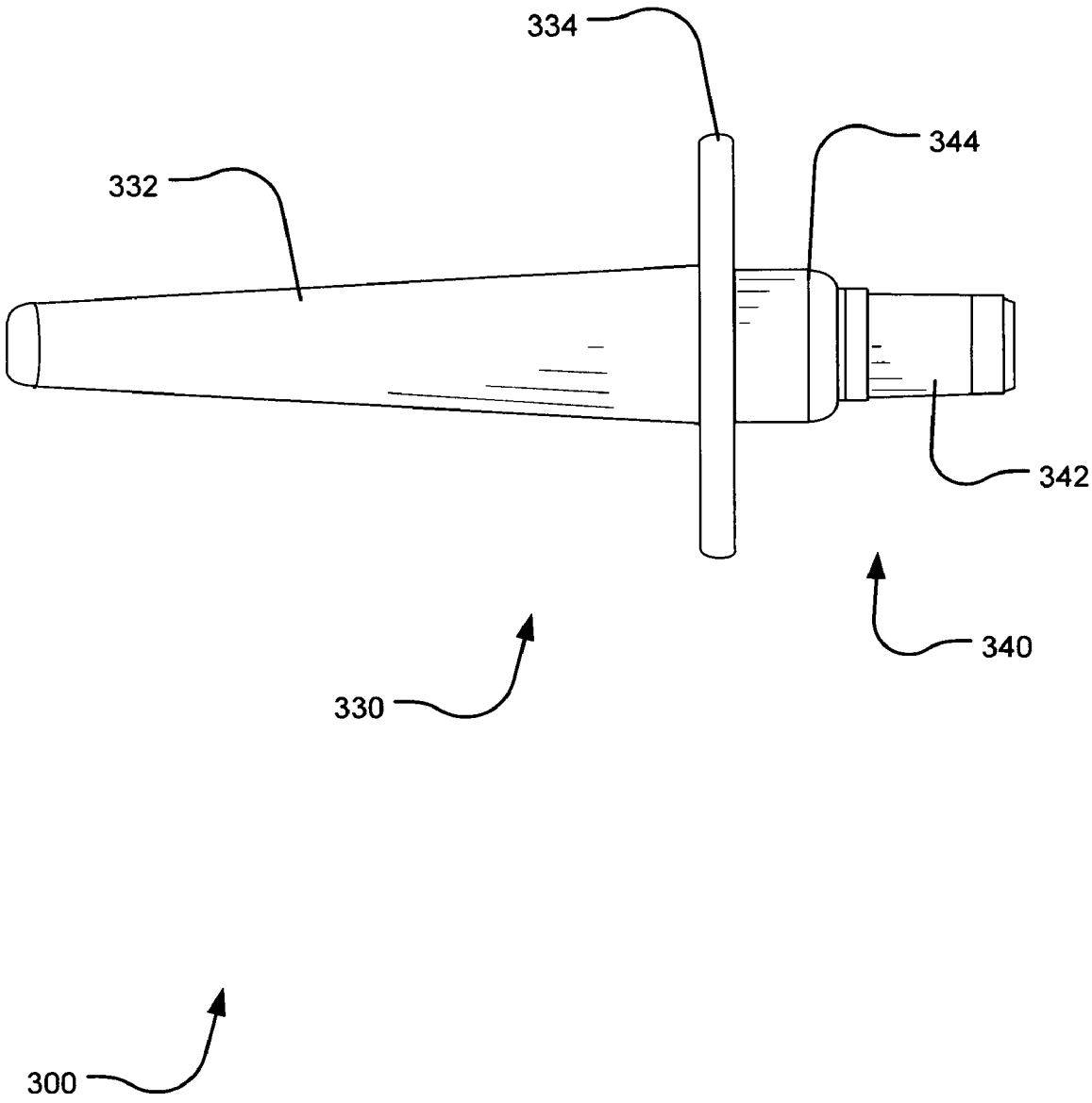
FIG. 3 illustrates a close-up side view of an exemplary embodiment of a patient hydration system showing a safety guard and mouthpiece in more detail.

FIG. 3 illustrates a close-up side view of an exemplary embodiment of a patient hydration system 300 showing the safety guard 330 and mouthpiece 340 in more detail. The handle portion 332 of the safety guard 330 is apparent as is the safety ring 334. The outside diameter of the safety ring 334 is such that it inhibits the safety guard 330 from fully entering a patient's mouth and causing a choking hazard. Also shown are the bite valve 342 and the valve retainer 344 which are components of the mouthpiece 340.

The tube 220 enters the rear of the handle portion 332 and connects to the bite valve 342 via a standard type barb fitting or other type of fitting. The valve retainer 344 fits over the bite valve 342 and retains it against the safety ring 334 which is attached to the handle 332. The components can be manufactured such that they lock together to form a single mouthpiece 340 and safety guard 330 assembly that minimizes the chances of a component disengaging from the assembly and creating a choking hazard.

The above specification, examples and data provide a description of the structure and use of exemplary embodiments of the described articles of manufacture and methods. Many embodiments can be made without departing from the spirit and scope of the invention.

What is claimed is:

1. A patient hydration system, comprising:

a bladder having a port, the bladder configured to hold a plurality of liquids and the port allowing the plurality of liquids to exit the bladder;

a flexible tube having a distal end and a proximal end, wherein the proximal end is connected to the port of the bladder;

a mouthpiece connected to the distal end of the tube, the mouthpiece having a valve configured to allow the plurality of liquids to controllably flow from the bladder, through the tube, and out of the mouthpiece upon activation of the valve;

a safety guard configured to attach to the mouthpiece and having a disk shaped safety ring that extends radially from the safety guard with an outside diameter sized to inhibit the safety guard from entering a patient's mouth;

an attachment means in proximity to the bladder for receiving a retention member;

the retention member comprising a hook that attaches to the attachment means and allows the system to be hung up; and wherein the plurality of liquids can flow from the bladder, through the flexible tube, out of the mouthpiece and into a patient's mouth upon activation of the valve.

2. The patient hydration system of claim 1, further comprising a secondary port that allows the plurality of liquids to be added to the bladder.

3. The patient hydration system of claim 1, wherein the bladder has measuring indicia that allows a level of the plurality of liquids in the bladder to be determined.

4. The patient hydration system of claim 1, wherein the port comprises a threaded male fitting that receives a threaded female fitting on the proximal end of the tube.

5. The patient hydration system of claim 1, further comprising a shut-off valve that can inhibit the flow of the plurality of liquids through the system.

6. The patient hydration system of claim 1, wherein the tube attaches to the port by sliding the tube over a barbed protrusion that extends downwards from the port.

7. The patient hydration system of claim 1 further comprising a keeper clip slidably attached to the tube in proximity to the safety guard and configured to removably attach to a patient's clothes.

8. The patient hydration system of claim 1, wherein the safety guard has slots that can be used in conjunction with a hook to hang up the safety guard.

9. A patient hydration system, comprising:

a bladder having a port, the bladder configured to hold a plurality of liquids and the port allowing the plurality of liquids to exit the bladder;

a flexible tube having a distal end and a proximal end, wherein the proximal end is connected to the port of the bladder;

a mouthpiece connected to the distal end of the tube, the mouthpiece having a bite valve configured to allow the plurality of liquids to controllably flow from the bladder, through the tube, and out of the mouthpiece upon activation of the valve;

a safety guard configured to attach to the mouthpiece and having a disk shaped safety ring that extends radially from the safety guard with an outside diameter sized to inhibit the safety guard from entering a patient's mouth;

an attachment means in proximity to the bladder for receiving a retention member;

the retention member comprising a hook that attaches to the attachment means and allows the system to be hung up;

wherein the mouthpiece further comprises a valve retainer wherein the bite valve attaches to the distal end of the tube and the valve retainer secures the bite valve to the safety ring; and wherein the plurality of liquids can flow from the bladder, through the flexible tube, out of the mouthpiece and into a patient's mouth upon activation of the valve.

10. The patient hydration system of claim 9, further comprising a secondary port that allows the plurality of liquids to be added to the bladder.

11. The patient hydration system of claim 9, wherein the bladder has measuring indicia that allows a level of the plurality of liquids in the bladder to be determined.

12. The patient hydration system of claim 9, wherein the port comprises a threaded male fitting that receives a threaded female fitting on the proximal end of the tube.

13. The patient hydration system of claim 9, further comprising a shut-off valve that can inhibit the flow of the plurality of liquids through the system.

14. The patient hydration system of claim 9, wherein the tube attaches to the port by sliding the tube over a barbed protrusion that extends downwards from the port.

15. The patient hydration system of claim 9 further comprising a keeper clip slidably attached to the tube in proximity to the safety guard and configured to removably attach to a patient's clothes.

16. The patient hydration system of claim 9, wherein the safety guard has slots that can be used in conjunction with a hook to hang up the safety guard.

* * * * *